US007423366B2

(12) United States Patent
Koelger et al.

(10) Patent No.: US 7,423,366 B2
(45) Date of Patent: Sep. 9, 2008

(54) LAMP ASSEMBLY

(76) Inventors: John M. Koelger, 1000 NE. Circle Blvd., Corvallis, OR (US) 97330-4239; P. Guy Howard, 1000 NE. Circle Blvd., Junction, OR (US) 97330-4239

( * ) Notice: Subject to any disclaimer, the term of this patent is extended or adjusted under 35 U.S.C. 154(b) by 394 days.

(21) Appl. No.: 11/093,667

(22) Filed: Mar. 29, 2005

(65) Prior Publication Data

US 2006/0220508 A1 Oct. 5, 2006

(51) Int. Cl.
*H01J 17/28* (2006.01)
*H01J 9/26* (2006.01)

(52) U.S. Cl. ..... 313/46; 313/146; 313/151; 313/545; 313/552; 313/634; 362/267; 362/345; 445/25; 445/26; 445/44

(58) Field of Classification Search ..... 313/11, 313/46, 113, 146, 148, 151, 545, 552, 632; 362/267, 294, 310, 345
See application file for complete search history.

(56) References Cited

U.S. PATENT DOCUMENTS 3,808,496 A * 4/1974 McRae et al. ..... 313/113
4,179,037 A * 12/1979 Chan et al. ..... 220/2.3 R
4,599,540 A * 7/1986 Roberts ..... 313/570
5,501,425 A 3/1996 Reinicke et al.
5,768,853 A 6/1998 Bushnell et al.
5,973,842 A 10/1999 Spangenberg
6,013,918 A 1/2000 Bushnell et al.
6,023,875 A 2/2000 Fell et al.
6,114,807 A * 9/2000 Kavanagh ..... 313/570
6,181,053 B1 * 1/2001 Roberts ..... 313/46
6,184,794 B1 2/2001 Tucholski
6,554,822 B1 4/2003 Holschneider et al.
6,557,734 B2 5/2003 Buazza et al.
2001/0048002 A1 12/2001 Buazza et al.
2002/0018824 A1 2/2002 Buazza et al.

* cited by examiner

*Primary Examiner*—Nimeshkumar Patel
*Assistant Examiner*—Thomas A Hollweg

(57) ABSTRACT

A lamp assembly includes a reflector body having an integral crimping portion that extends inwardly over a channel formed in the reflector body, a seal feature arranged within the channel, a cathode assembly having an edge feature extending into the channel, and a resilient member held in a state of compression between the crimping portion and a first surface of the edge feature such that an opposing second surface of the edge member is held against the sealing feature thereby creating a hermetic seal between the cathode assembly and the reflector body wherein the crimping portion is configured to remain in contact with the resilient member if the hermetic seal becomes non-hermetic.

25 Claims, 10 Drawing Sheets

LAMP ASSEMBLY

BACKGROUND

Digital projectors, such as digital mirror devices (DMD) and liquid crystal display (LCD) projectors, project high-quality images onto a viewing surface. Both DMD and LCD projectors utilize high-intensity burners and reflectors to generate the light needed for projection. Light generated by the burner is concentrated as a "fireball" that is located at a focal point of a reflector. Light produced by the fireball is directed into a projection assembly that produces images and utilizes the generated light to form the image. The image is then projected onto a viewing surface.

Efforts have been directed at making projectors more compact while making the image of higher and better quality. As a result, the lamps utilized have become more compact and of higher intensity. An example of one type of such lamp is a xenon lamp. Xenon lamps provide a relatively constant spectral output with significantly more output than other types of lamps without using substantial amounts of environmentally harmful materials, such as mercury. In addition, xenon lamps have the ability to hot strike and subsequently turn on at near full power.

Xenon lamps include an anode and a cathode. The anode and cathode are precisely positioned relatively to one another such that a gap is established between them. The application of a voltage to the anode causes the voltage to arc to the cathode in the presence of the pressurized xenon gas, thereby generating light. In addition to generating light, the xenon lamp also produces heat. As this heat raises the temperature of the xenon lamp, the pressure in the xenon lamp is also raised. The lamps can suddenly fail in the event that the pressure and/or temperature inside exceed a certain threshold.

SUMMARY

A lamp assembly includes a reflector body having an integral crimping portion that extends inwardly over a channel formed in the reflector body, a seal feature arranged within the channel, a cathode assembly having an edge feature extending into the channel, and a resilient member held in a state of compression between the crimping portion and a first surface of the edge feature such that an opposing second surface of the edge member is held against the sealing feature thereby creating a hermetic seal between the cathode assembly and the reflector body wherein the crimping portion is configured to remain in contact with the resilient member if the hermetic seal becomes non-hermetic.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

A lamp assembly for use in a display system is provided herein that includes pressure relief features. According to several exemplary embodiments discussed below, the pressure relief features provide a gas escape pathway that allows gas within the lamp assembly to escape once the pressure within the lamp assembly exceeds a predetermined threshold. For example, according to several exemplary embodiments, a lamp assembly includes an integrated unit with crimping portions. The crimping portions exert a compressive force on a spring washer. A portion of the compressive force is transferred to a cathode assembly, which in turn exerts a sealing force on a ring seal to thereby seal the cathode assembly relative to the integrated unit.

The amount of the compressive force, and hence the portion of the compressive force that results in the sealing force, may be adjusted. According to several exemplary embodiments described herein, the amount of sealing force may depend on the dimensions of the crimping portions and on the degree to which the crimping portions are crimped. As the pressure within the lamp assembly exerts a force sufficient to overcome the sealing force, the pressurized gas escapes while a portion of the compressive force applied to the cathode assembly the crimping portions retains the cathode assembly in contact with the integrated unit. Several exemplary sealing configurations will be discussed herein that include pressure relief features, such as a gas escape pathway.

In the following description, for purposes of explanation, numerous specific details are set forth in order to provide a thorough understanding of the present method and apparatus. It will be apparent, however, to one skilled in the art, that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Display System

Figure 1:
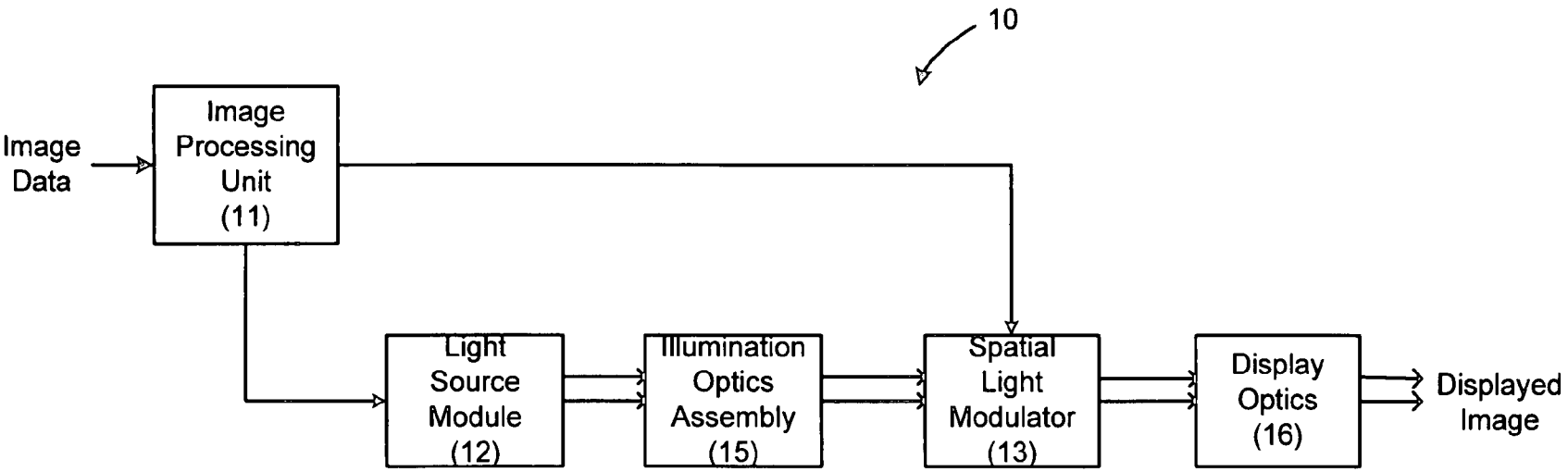
FIG. 1 illustrates a schematic view of a display system according to one exemplary embodiment.

FIG. 1 illustrates an exemplary display system (10). The components of FIG. 1 are exemplary only and may be modified or changed as best serves a particular application. As shown in FIG. 1, image data is input into an image processing unit (11). The image data defines an image that is to be displayed by the display system (10). While one image is illustrated and described as being processed by the image processing unit (11), it will be understood by one skilled in the art that a plurality or series of images may be processed by the image processing unit (11). The image processing unit (11) performs various functions including, but not limited to, controlling the illumination of a light source module (12) and controlling a spatial light modulator (SLM) (13). The terms "SLM" and "modulator" will be used interchangeably herein to refer to a spatial light modulator.

As will be discussed in more detail below, the light source module (12) includes a lamp assembly, which includes an anode and a cathode coupled to a reflector, and a fan. The fan helps to maintain the lamp assembly at an acceptable operating temperature. The lamp assembly also includes an integrated reflector and heat sink.

Continuing with FIG. 1, the light source module (12) is positioned with respect to an illumination optics assembly (15). The illumination optics assembly (15) directs light from the light source module (12) to the SLM (13). The incident light received by the SLM (13) may be modulated in its phase, intensity, polarization, or direction by the modulator (13). Thus, the SLM (13) of FIG. 1 modulates the light based on input from the image processing unit (11) to form an image-bearing beam of light that is eventually displayed or cast by display optics (16) onto a viewing surface (not shown).

The display optics (16) may include any device configured to display or project an image. For example, the display optics (16) may be, but are not limited to, a lens configured to project and focus an image onto a viewing surface. The lamp assembly portion of the light source module (12).will now be discussed in more detail.

Lamp Assembly with Ring Seal and Spring Washer

Figure 2:
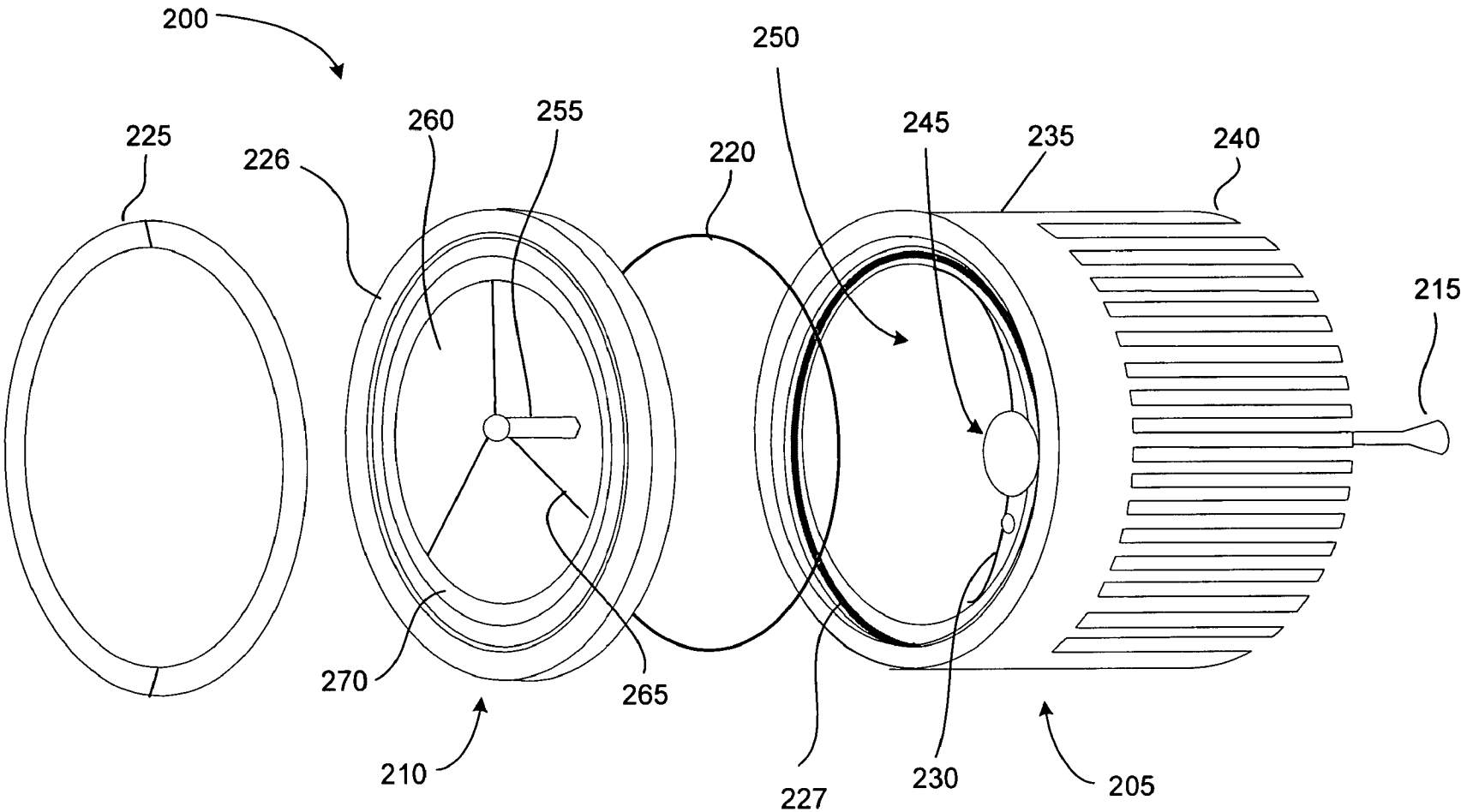
FIG. 2 illustrates an exploded perspective view of a lamp assembly according to one exemplary embodiment.

FIG. 2 illustrates an exploded view of an exemplary lamp assembly (200) that includes an integrated unit (205), a cathode assembly (210), and an anode (215). When the lamp assembly (200) is assembled, the anode (215) is sealingly coupled to the integrated unit (205). The cathode assembly (210) is also sealingly coupled to the integrated unit (205). In particular, a ring seal (220), a resilient member, such as a spring washer (225), and an edge feature, such as ceramic isolation ring (226) may be used to establish a seal between the cathode assembly (210) and the integrated unit (205). According to the present exemplary embodiment, a sealing feature, such as a ring seal (220) is located between the isolation ring (226) and the body (235) of the integrated unit (205). The ring seal (220) may be disposed within a channel (227) near the distal end of the integrated unit (205). The illustrated configuration of the lamp assembly (200) provides a gas escape pathway. The spring washer (225), the isolation ring (226) and the ring seal (220), as well as the gas escape pathway, will be discussed in more detail below with reference to FIG 3.

Continuing with FIG. 2, the integrated unit (205) functions as a reflector and heat sink. For ease of reference only, a xenon lamp assembly will be discussed in more detail below with reference to FIG. 3. However, those of skill in the art will appreciate that other types of lamps may make use of an integrated unit (205) and the sealing configurations described below. As shown, the integrated unit (205) includes a reflective surface (230), a body (235), a plurality of integral cooling fins (240), and a reflector opening (245). The integrated unit (205) reflects visible light out and dissipates heat energy through the body (235) and the cooling fins (240).

The reflective surface (230) is formed in a cavity (250) defined in the distal end of the body (235). The cavity (250), according to one exemplary embodiment, may be hyperbolic or parabolic in profile. As a result, a substantial portion of light originating from a focal point of the cavity (250) reflects off the reflective surface (230) and out of the integrated unit (205). In a xenon lamp assembly, light is generated when voltage arcs from the anode (215) to the cathode (255) in the presence of a pressurized gas, such as xenon. The sealing configuration of the cathode assembly (210) to the integrated unit (205) helps retain the pressurized gas within the lamp assembly (200). This sealing configuration will be discussed in more detail with reference to FIG. 3. Further, the sealing configuration provides for controlled pressure relief in the event that pressure within the cavity (250) the xenon gas escapes.

Light in the visible spectrum is the desired output of a lamp used in projector systems. However, lamps frequently also generate significant radiant energy outside the visible spectrum. The reflective surface (230) may include a radiation absorption layer, such as an infrared and/or ultraviolet radiation absorption material to convert radiant energy to thermal heat. As radiant energy is converted to thermal heat by the infrared and/or ultraviolet radiation absorption layer, the radiant heat is absorbed by the body (235) of the integrated unit (205).

According to one exemplary embodiment, the body (235) is metallic. The use of a metallic body allows thermal heat to be more readily absorbed by the body (235), such that the body (235) functions an integrated heat sink. Heat absorbed by the body (235) is then conveyed to the cooling fins (240).

The amount of heat transferred by an object depends, at least in part, on the exposed surface area of the object. The cooling fins (240) increase the heat transfer rate to the environment by increasing the exposed surface area of the integrated unit (205). The spacing of the cooling fins (240) helps ensure that as air around one cooling fin is heated, that heated air will not substantially heat air around an adjacent cooling fin, which would slow heat transfer.

The amount of heat transferred from an object by convection, either natural or forced, depends at least in part on how the air flows over the object. Heat transfer may be maximized by increasing the speed of the airflow and/or by making the airflow turbulent. In the case of airflow generated in fan assemblies, the speed of the airflow used to cool lamps may be somewhat limited because of the noise, size, and other considerations. Accordingly, it may be desirable to make the air flow turbulent as it flows over the integrated unit (205).

According to one exemplary embodiment, the cooling fins (240) enhance heat removal from the body (235) by creating turbulence. The cooling fins (240) are elongated members integrally formed with the body (235) and thus may be made from the same material. The shape of the cooling fins (240) is such that an airflow that passes over the cooling fins (240) becomes turbulent. Causing the airflow to become turbulent may increase the heat transfer rate of the integrated unit (205) by as much as a factor of two or more.

The distance by which the anode (215) and the cathode (255) are separated is referred to as the gap distance. By establishing the proper gap distance, light is generated when voltage is applied to the anode (215) while the cavity (250) is filled with a pressurized gas, such as xenon.

According to one exemplary embodiment, the cathode assembly (210) provides an electrical path to the cathode (255) while providing support for the cathode (255). The cathode assembly (210) includes the cathode (255), a lens (260), cathode support structure (265) and a face cap (270). According to the present exemplary embodiment, the isolation ring (226) is also coupled to the face cap (270). In particular, the window (260), the cathode support structure (265), and the isolation ring (226) may be sealing coupled to the face cap (270) through a vacuum brazing operation or by any other suitable process. The cathode (255) is coupled to the cathode support structure (265) to support the cathode (255).

Accordingly, the face cap (270) and the cathode support structure (265) provide physical support for the cathode (255).

According to one exemplary embodiment, the cathode support structure (265) and the face cap (270) provide an electrical pathway for the cathode (255). The cathode support structure (265) and the face cap (270) are made of electrically conductive material, such as metal, so that the cathode (255) is at substantially the same voltage level as the face cap (270) which is electrically charged. Consequently, when voltage is applied to the anode (215) in the presence of a pressurized gas, the voltage arcs across the gap distance to the cathode (255) because the cathode (255) is at a lower voltage level or ground. This arc provides the "fireball."

Figure 3:
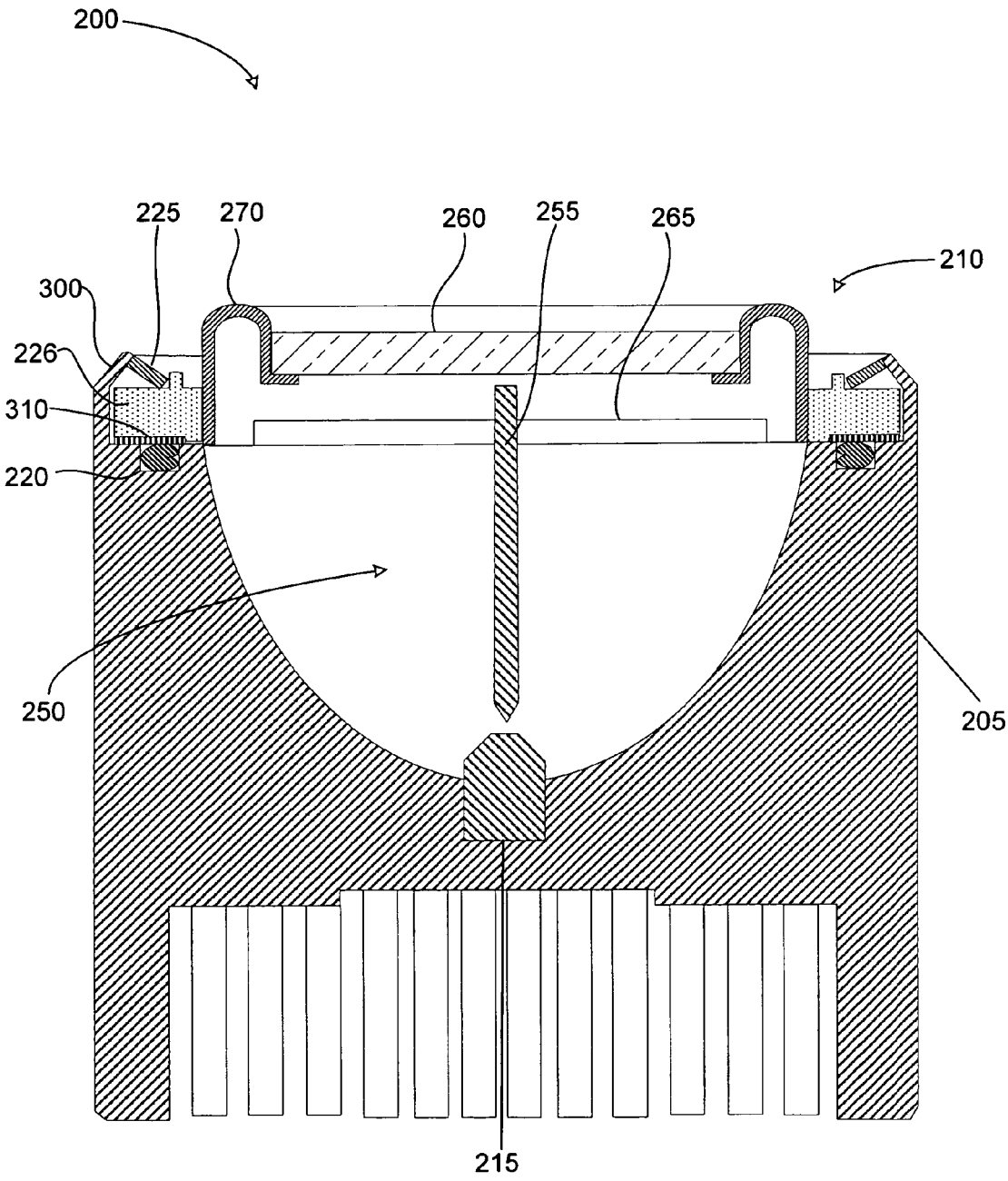
FIG. 3 is a cross sectional view of the lamp assembly of FIG. 2 according to one exemplary embodiment.

FIG. 3 illustrates a cross sectional view of the lamp assembly (200) showing the sealing configuration of the lamp assembly (200) in more detail. A ring seal (220), such as a metallic C-ring seal, is placed at least partially within the channel (227; FIG. 2) formed in one end of the integrated unit (205). The ring seal (220) is configured to interface with the cathode assembly (210; FIG. 2). In particular, the cathode assembly (210; FIG. 2) includes a window (260) that is supported by a face cap (270). The face cap (270) in turn is coupled to the isolation ring (226). The interior portion of the spring washer (225) is also placed into contact with the isolation ring (226). The isolation ring (226) is then placed into contact with the integrated unit (205) and in particular into contact with the ring seal (220).

The spring washer (225) is configured to be placed in contact with crimping portions (300). More specifically, the crimping portions (300) are configured to be plastically deformed into a crimped position. As the crimping portions (300) are thus deformed, they exert a compressive force on the outer portion of the spring washer (225). As the spring washer (225) is compressed, the beveled spring washer is compressed or urged to a flat position. The compression of the spring washer (225) against the isolation ring (226) causes a portion of the compressive force to be transferred from the spring washer (225) through the isolation ring (226) to the ring seal (220). The force exerted on the ring seal (220) may be referred to as a sealing force.

The sealing force on the ring seal (220) causes an interference fit between the isolation ring (226) and the ring seal (220), thereby establishing a seal between the cathode assembly (210) and the integrated unit (205). The interference fit, and thus the seal, between the isolation ring (226) and the ring seal (220) may be enhanced by depositing a thin layer of metallic material on the interior portion of the isolation ring (226). The thin layer of metallic material (310) may be formed of a soft metallic material, such as copper or gold, which allows for a more extensive interference fit as the ring seal (220) deforms the metallic layer (310) in response to the compressive force.

The magnitude of the sealing force exerted on the ring seal (220) depends, at least in part, on the amount of deformation of the crimping portions (300). For example, the closer the crimping portions (300) are deformed toward the ring seal (220), the larger the magnitude of the compressive force applied to the spring washer (225). The magnitude of the sealing force may be selectively applied.

For example, the amount of compressive force applied to the spring washer (225) also depends on the dimensions of the crimping portions (300). For example, relatively thicker crimping portions (300) may apply a larger sealing force compared to thinner crimping portions (300), given the same deformation. Accordingly, the amount of sealing force applied by the crimping portions may be selected by determining the amount of deformation and the characteristics of the crimping portions (300).

As previously discussed, the sealing force acts to seal the pressurized gas within the cavity (250). The pressure of the gas exerts an expansion force against the cathode assembly (210). This expansion force acts in opposition to the sealing force. While the sealing force is greater than the expansion force, the ring seal (220) will remain in sealing contact with the spring washer (225), as is shown in FIG. 3.

Figure 4:
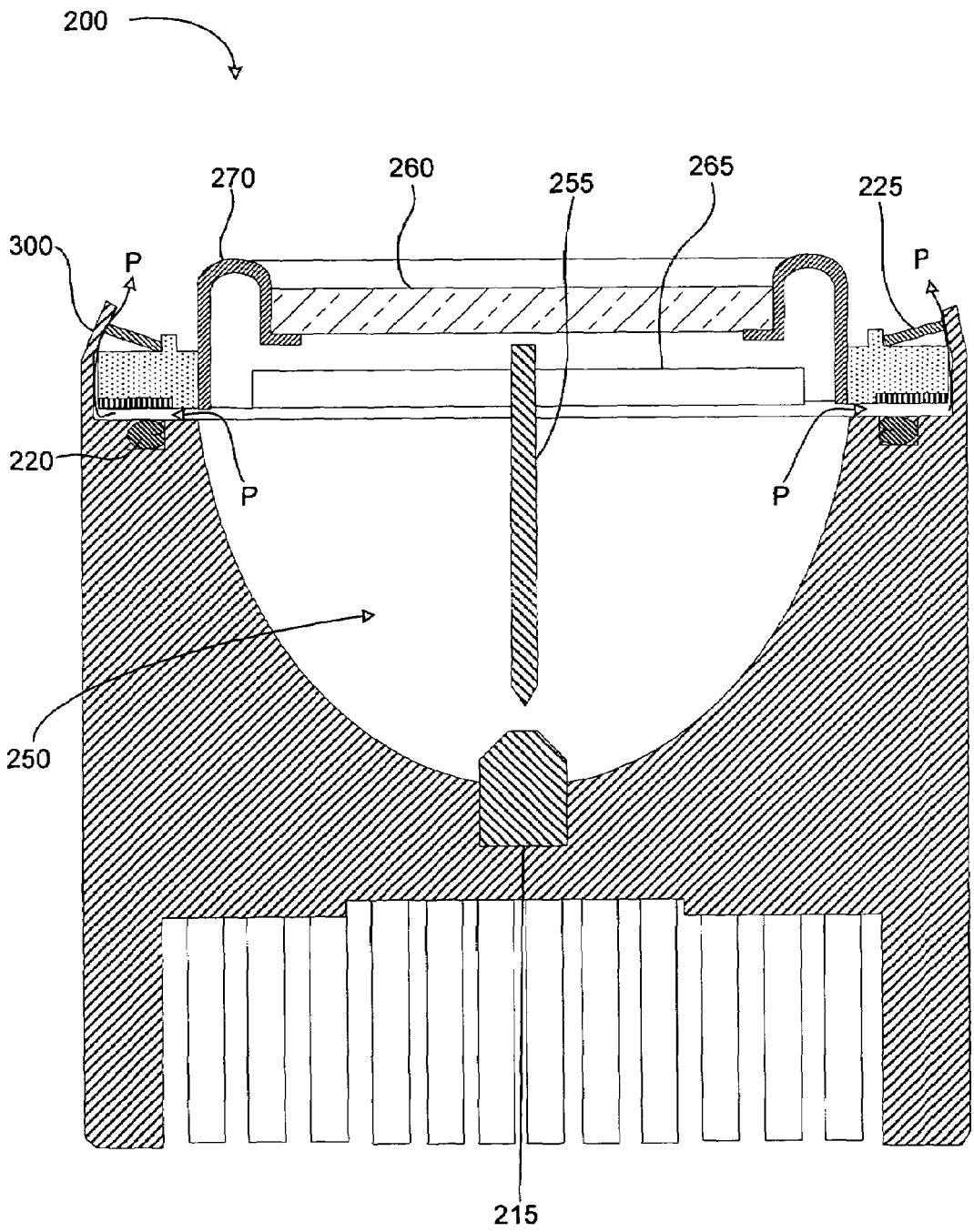
FIG. 4 is a cross sectional view of a lamp assembly according to one exemplary embodiment.

FIG. 4 illustrates a cross sectional view of the lamp assembly (200) in which the expansion force exerted on the cathode assembly (210; FIG. 2) is greater than the sealing force. As the expansion force becomes larger than the sealing force, the cathode assembly (210; FIG. 2) is urged away from the cavity (250; FIG. 2). As the cathode assembly (210; FIG. 2) moves away from the cavity (250; FIG. 2), a gap is created between the ring seal (220) and the isolation ring (226). The gap allows the pressurized gas within the cavity (250; FIG. 2) to escape, as illustrated by the arrows P in FIG. 4. As the gas escapes, the pressure within the cavity (250; FIG. 2) decreases. As the pressure within the cavity (250; FIG. 2) decreases, the lamp assembly (200) may no longer operate, or may do so dimly.

Further, as the gas escapes, it does so in a controlled manner. In particular, the sealing configuration provides a controlled gas escape route. For example, as previously discussed, when the expansion force is larger than the sealing force, a gap is established between the ring seal (220) and the isolation ring (226). Thereafter, the gas is travels around the isolation ring (226) and escapes around the spring washer (225).

As the gas escapes, the crimping portions (300) continue to exert a compressive force on the spring washer (225). This compressive force causes the integrated unit (205; FIG. 2) to remain in contact with the spring washer (225). This contact causes the spring washer (225) to remain in contact with the isolation ring (226) and hence the cathode assembly (210; FIG. 2). Consequently, the sealing configuration provides a controlled gas escape route in the event of seal failure, such that the integrated unit (205; FIG. 2) remains in contact with the cathode assembly (210: FIG. 2), thereby reducing the possibility that the cathode assembly (210; FIG. 2) or parts thereof will become airborne.

Accordingly, the lamp assembly, according to the present exemplary embodiment, provides a gas escape route as a pressure relief feature to protect the rest of the assembly in the event of sudden failure. Further, according to the present exemplary embodiment, the threshold for failure may be selected, such as by selecting the properties of the crimping portions and/or the amount of compressive force applied by the deformation of the crimping portions (300).

The sealing configuration may be rapidly established using relatively simple operations. For example, the ring seal (220) may be rapidly placed within the channel (227; FIG. 2) while minimizing or reducing the use of specialized labor. Further, the spring washer (225) may be rapidly placed into contact with the ring seal (220) and thereafter a relatively simple crimping operation may be performed to form the seal, as previously discussed. Suitable spring washers include, without limitation, Belleville type washers. Suitable ring seals include, without limitation, steel C-type Wills-type ring seals. Other configurations also make use of spring washers, as will now be discussed in more detail.

Integral Sealing Surface

Figure 5:
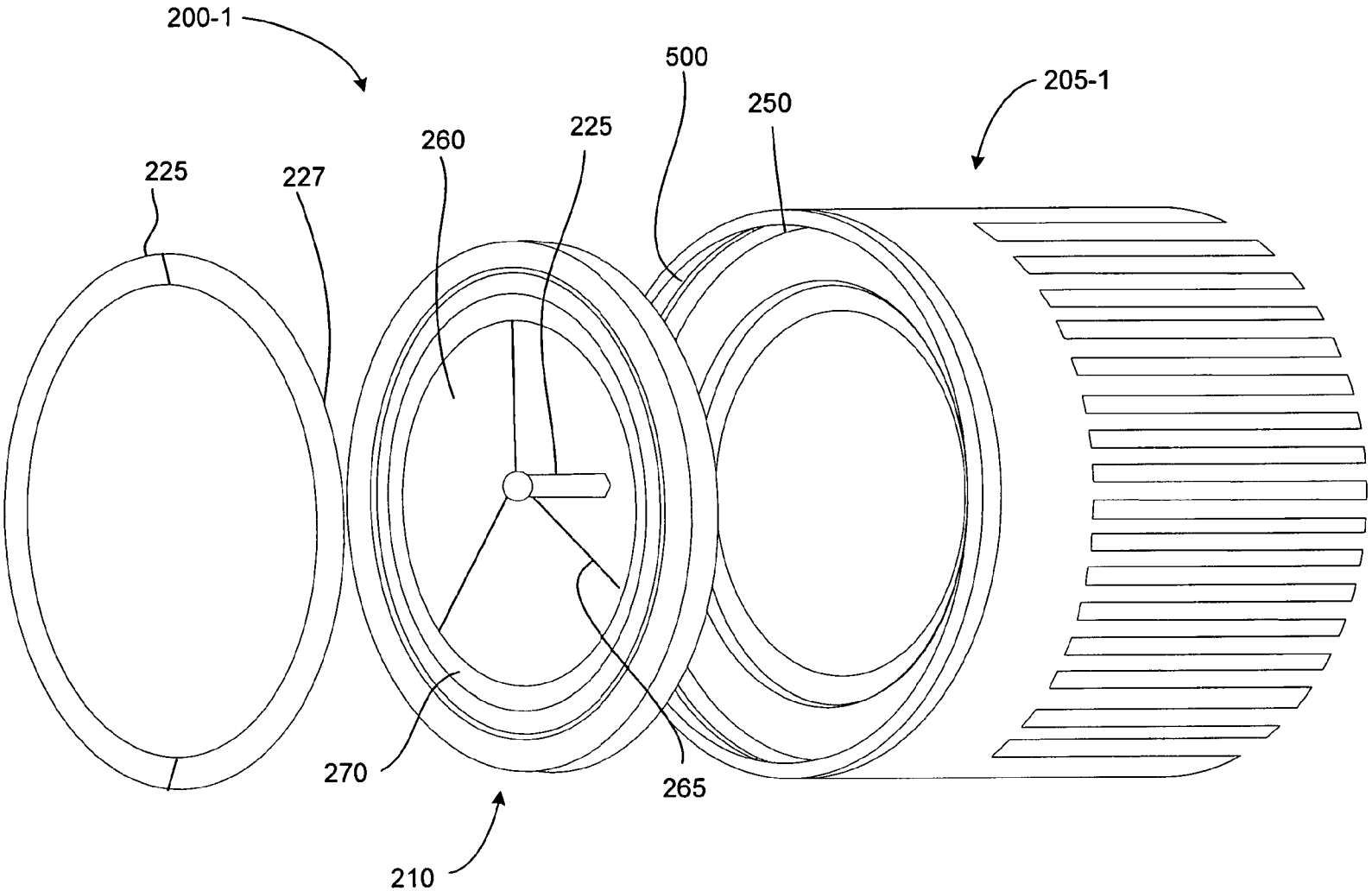
FIG. 5 illustrates an exploded perspective view of a lamp assembly according to one exemplary embodiment.
Figure 6:
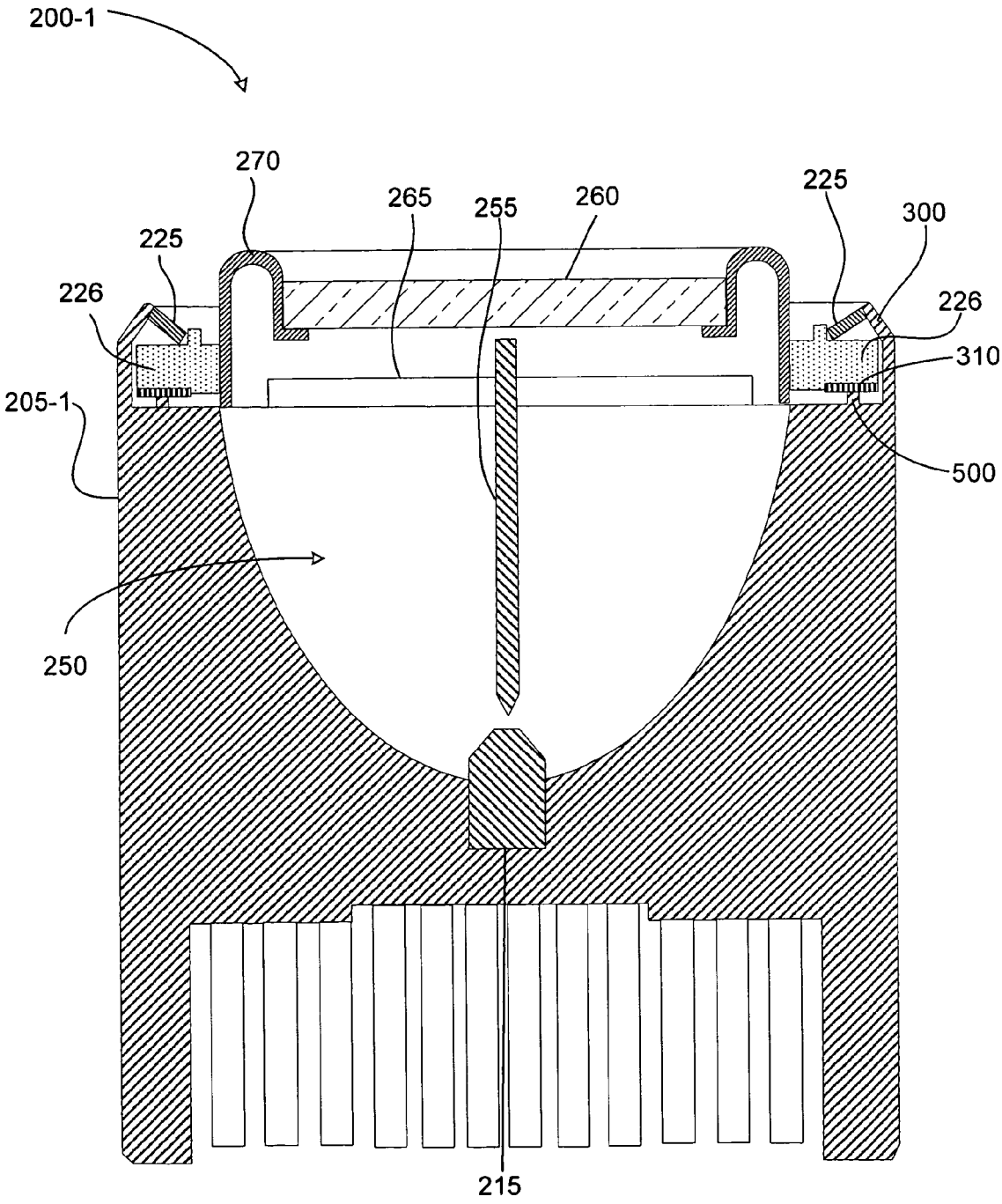
FIG. 6 illustrates a cross sectional view of the lamp assembly of FIG. 5 according to one exemplary embodiment.

FIGS. 5 and 6 illustrate a lamp assembly (200-1) with a pressure relief feature that includes an integrated unit (205-1)

having an integral sealing surface (500). In particular, FIG. 5 illustrates a perspective view of the lamp assembly (200-1) and FIG. 6 illustrates a cross sectional view of the lamp assembly.

The integral sealing surface (500) is formed around the perimeter of the opening of the cavity (250) during the formation of the integrated unit (205-1). In particular, the integrated unit may be formed using molding and/or machining operations. The integral sealing surface may be formed during this process, such as by including features in the mold which correspond to the resulting shape of integral sealing surface (500). Further, the integral sealing surface may be formed by machining processes, such as by turning or milling operations.

Accordingly, the integral sealing surface (500) is formed around the perimeter of the opening of the cavity (250). The dimensions of the integral sealing surface (500) correspond approximately to the dimensions of a soft metallic layer (310; FIG. 6) formed on the isolation ring (226). As a result, when the isolation ring (226) is placed in contact with the integrated unit (205-1; FIG. 6), the layer of soft material (310) is placed into contact with the integral sealing surface (500).

The integrated unit (205-1) also includes crimping portions (300; FIG. 6). As the crimping portions (300; FIG. 6) are plastically deformed against the spring washer (225; FIG. 6), the crimping portions (300; FIG. 6) exert a compressive force on the spring washer (225; FIG. 6), as previously discussed. This compressive force results in an interference fit between the soft metallic layer (310; FIG. 6) and the integral sealing surface (500). The resulting interference fit creates the hermetic seal to thereby retain the pressurized xenon gas within the lamp assembly (200-1).

Figure 7:
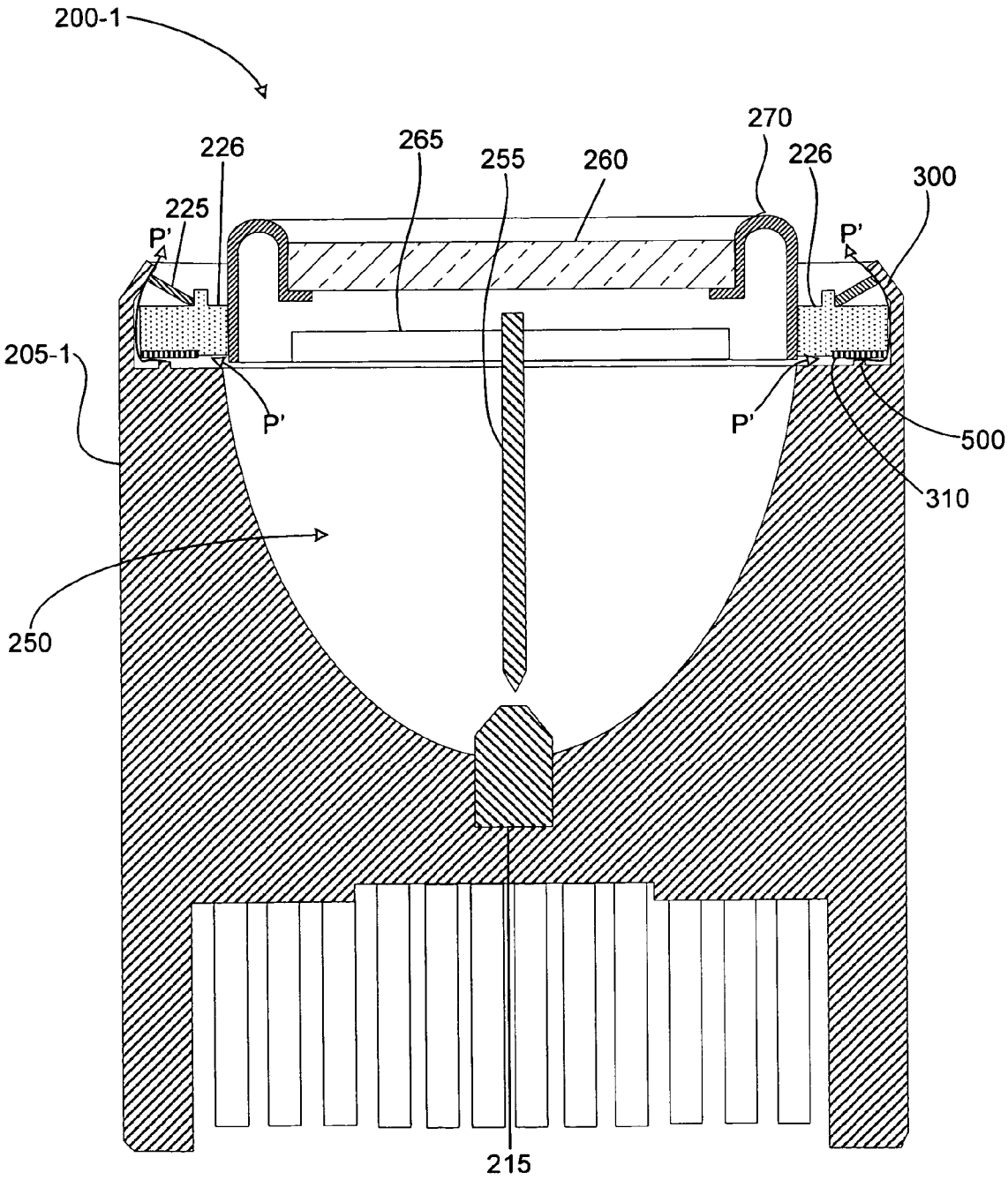
FIG. 7 illustrates a cross sectional view of the lamp assembly of FIG. 5 according to one exemplary embodiment.

As shown in FIG. 7, as the expansion forces exceed the sealing forces, a gap is formed between the integral sealing surface (500) and the isolation ring (226) such that the pressurized gas is allowed to escape from the lamp assembly (200-1) as indicated by the arrows P'. The crimping portions (300; FIG. 6) also remain in contact with the cathode assembly (205-1), such that the lamp assembly remains intact as the pressurized gas escapes.

Dead-soft Copper Ring Seal

Figure 8:
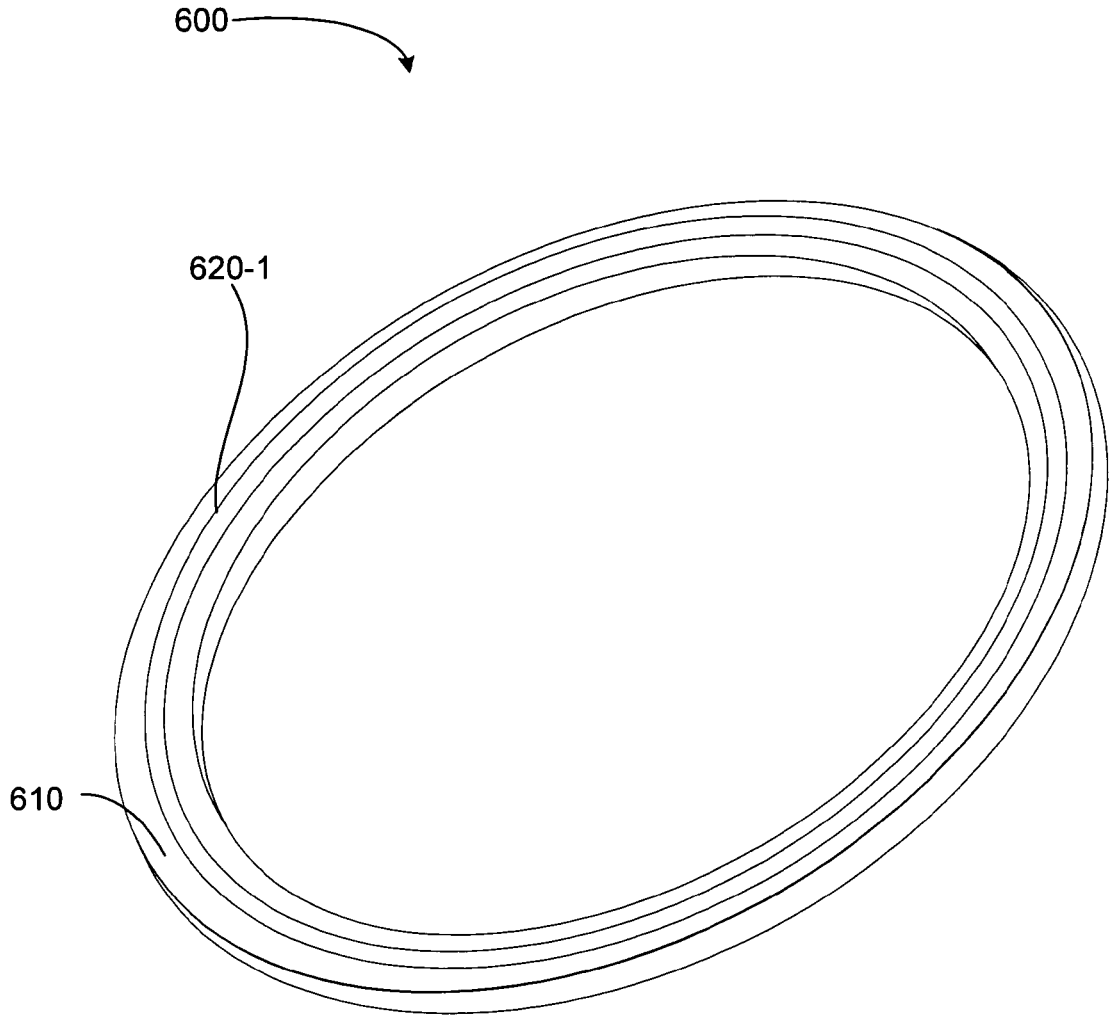
FIG. 8 is a perspective view of a ring seal according to one exemplary embodiment.
Figure 9:
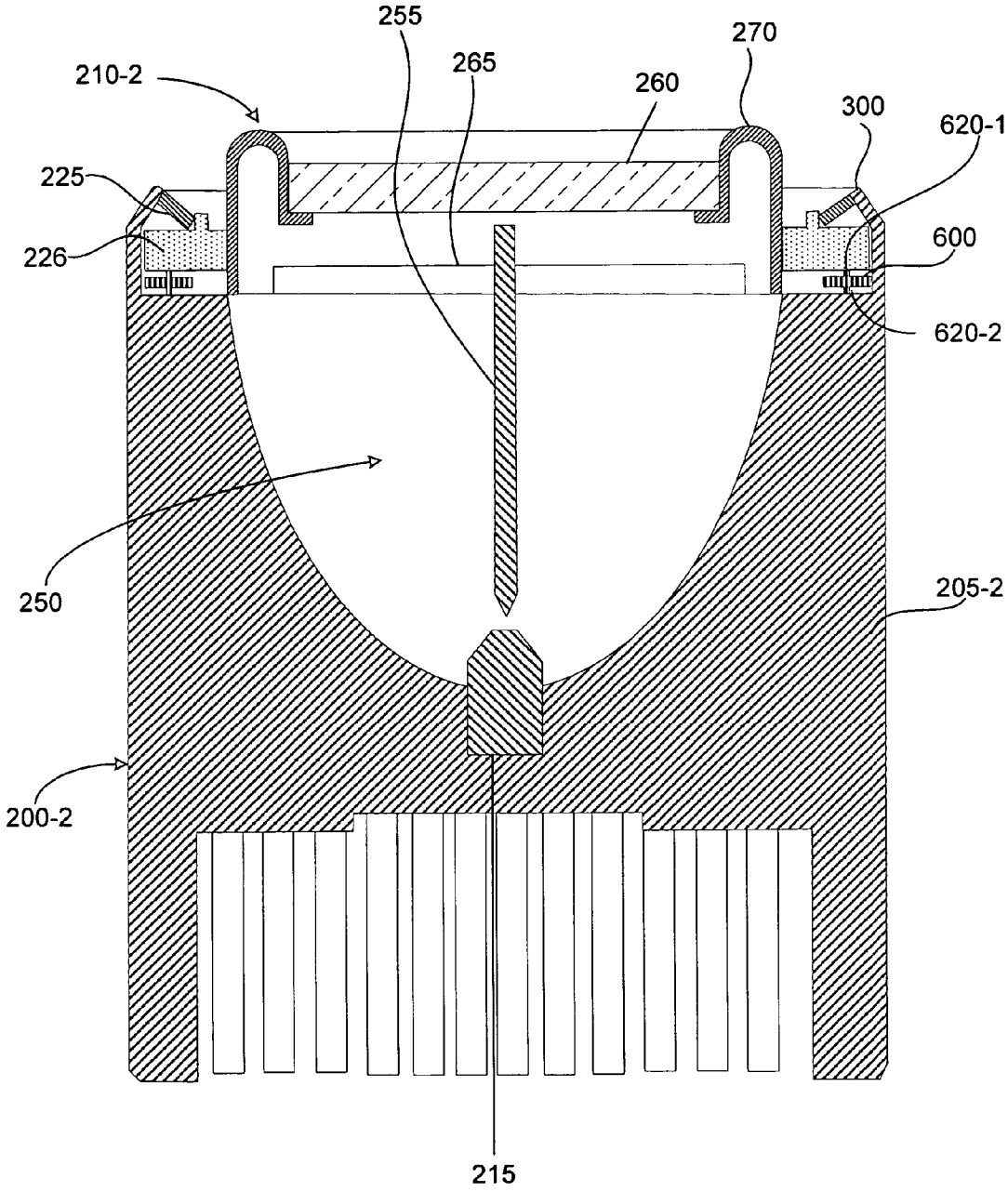
FIG. 9 is a cross sectional view of a lamp assembly according to one exemplary embodiment.

FIGS. 8 and 9 illustrates a copper ring seal (600) that may be incorporated in the lamp assembly (200), according to one exemplary embodiment. The deformable ring seal (600) has geometry that deforms under the force created by the compression of a spring washer (225). The deformable ring seal (600) includes a generally flat portion (610) and raised portions (620-1, 620-2, best seen in FIG. 8) on each side of the flat portion (610). These raised portions (620-1, 620-2) are configured to interface with the integrated unit (205-2) and the spring washer (225) to form a hermetic seal to retain pressurized xenon gas within a lamp assembly. Such an exemplary lamp assembly is illustrated in FIG. 9.

FIG. 9 illustrates a cross-sectional view of a lamp assembly (200-2). The lamp assembly (200-2) includes a deformable ring seal (600), an integrated unit (205-2), a spring washer (225), and a cathode assembly (210-2). The spring washer (225) and the deformable ring seal (600) are located between crimping portions (300) formed on the integrated unit (205-2).

As the crimping portions (300) are crimped against the spring washer (225), the spring washer exerts a compressive force on the deformable ring seal (600), which is between the spring washer (225) and the integrated unit (205-2). The deformable ring seal (600) may be formed of a relatively soft material, such as copper, which is softer than both the material chosen for the integrated unit (205-2) and the material chosen for the spring washer (225).

As a result, the compressive force generated by the crimping of crimping portions (300) against the raised portions (620-1, 620-2) causes the raised portions (620-1, 620-2) to deform at interface between the spring washer (225) and the integrated unit (205-2) respectively. The deformation of the raised portions (620-1, 620-2) results in an interference fit between the deformable ring seal (600), the integrated unit (205-2), and the spring washer (225) thereby providing a hermetic seal to retain the pressurized gas within the lamp assembly (200-2).

Figure 10:
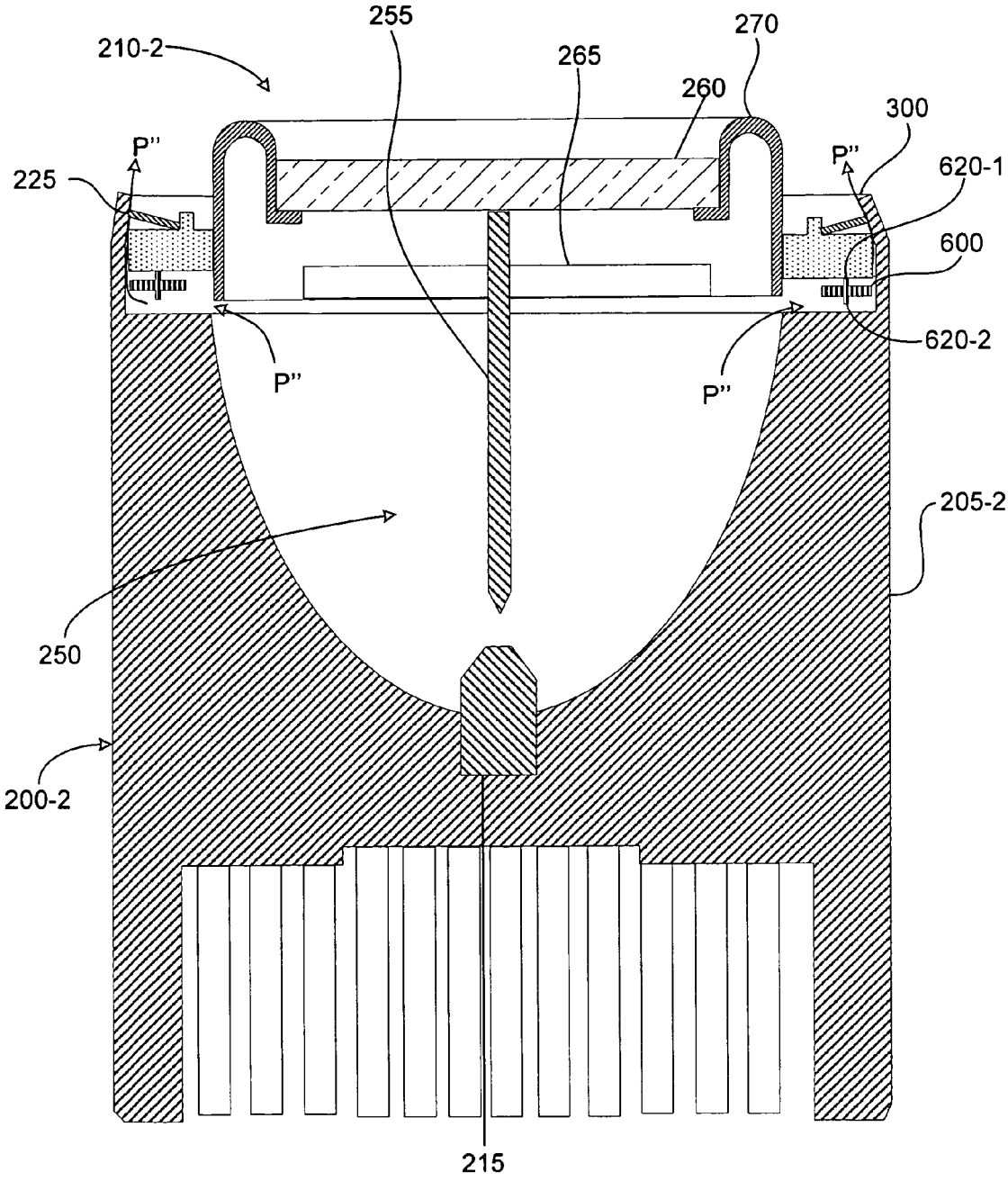
FIG. 10 is a cross sectional view of a lamp assembly according to one exemplary embodiment.

As shown in FIG. 10, as the expansion forces exceed the sealing forces, a gap is formed between the deformable ring seal (600) and the previously described interface of the integrated unit (205-2) such that the pressurized gas is allowed to escape from the lamp assembly (200-2). The crimping portions (300) remain in contact with the cathode assembly (205-2), such that the lamp assembly remains intact as the pressurized gas escapes, as indicated by the arrows P".

In conclusion, a lamp assembly for use in a display system has been discussed herein that includes pressure relief features. According to several exemplary embodiments discussed below, the pressure relief features provide a gas escape pathway that allows gas within the lamp assembly to escape once the pressure within the lamp assembly exceeds a predetermined threshold. For example, according to several exemplary embodiments, a lamp assembly includes an integrated unit with crimping portions. The crimping portions exert a compressive force on a spring washer. A portion of the compressive force is transferred to a cathode assembly, which in turn exerts a sealing force on a ring seal to thereby seal the cathode assembly relative to the integrated unit.

The amount of the compressive force, and hence the portion of the compressive force that results in the sealing force, may be adjusted. According to several exemplary embodiments, the amount of sealing force may depend on the dimensions of the crimping portions and on the degree to which the crimping portions are crimped. As the pressure within the lamp assembly exerts a force sufficient to overcome the sealing force, the pressurized gas escapes while a portion of the compressive force applied to the cathode assembly the crimping portions retains the cathode assembly in contact with the integrated unit.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the disclosure be defined by the following claims.

What is claimed is:

1. A lamp assembly, comprising:

a reflector body having an integral crimping portion that extends inwardly over a channel formed in said reflector body;

a seal arranged within said channel;

a cathode assembly supported on said seal in said channel;

a resilient member held in a state of compression between said crimping portion and said seal thereby creating a hermetic seal between said cathode assembly and said reflector body; and a gas escape pathway configured to provide a controlled release of pressurized gas when an expansion force exerted on said cathode assembly is greater than a sealing force applied by said crimping portion and said resilient member.

2. The lamp assembly of claim 1, wherein said channel is formed about a reflector cavity that is also formed within said reflector body, and further comprising:

an anode assembly arranged with said reflector cavity but electrically isolated from said cathode assembly; and a gas held within said cavity.

3. The lamp assembly of claim 1, and wherein said resilient member includes a spring washer.

4. The lamp assembly of claim 1, wherein said seal includes an isolation ring and a compressible seal member.

5. The lamp assembly of claim 4, wherein said compressible seal member includes a ring shaped seal.

6. The lamp assembly of claim 5, wherein said gas escape pathway is opened between said isolation ring and said ring shaped seal.

7. The lamp assembly of claim 4, wherein said seal further includes a deformable metallic member between said isolation ring and said compressible seal member.

8. The lamp assembly of claim 7, wherein said deformable metallic member is made of copper.

9. The assembly of claim 7, wherein said deformable metallic member includes a generally flat portion and raised portions on opposing sides of said generally flat portion.

10. The lamp assembly of claim 1, wherein said seal includes a ridge against which said resilient member abuts, said resilient member abutting both said ridge and said crimping portion.

11. The lamp assembly of claim 1, wherein said seal comprises an isolation ring that abuts an integral sealing surface formed in said channel from said reflector body.

12. The lamp assembly of claim 11, further comprising a metallic layer on said isolation ring, between said isolation ring and said integral sealing surface.

13. The lamp assembly of claim 1, wherein said seal comprises an isolation ring and a deformable metal ring seal.

14. A lamp assembly, comprising:

an integral reflector and heat sink, said integral reflector and heat sink including a plurality of cooling fins formed on a first end and a cavity defined in a second end, said cavity being surrounded by an opening and having crimping portions extending beyond said opening;

a ring seal disposed about said opening;

an isolation ring coupled to said opening; and a spring washer coupled to said isolation ring, wherein said crimping portions are configured to be selectively deformed to exert a compressive force on said spring washer, said isolation ring, and said ring seal to provide a hermetic seal between said ring seal and said isolation ring below a first pressure threshold and to provide a gas escape pathway above said first pressure threshold;

wherein said gas escape pathway is configured to provide a controlled release of pressurized gas when an expansion force created by said pressurized gas in said cavity is greater than said compressive force applied to said spring washer.

15. The assembly of claim 14, wherein a deformation of said crimping portions is selected to establish said first pressure threshold.

16. The assembly of claim 14, wherein dimensions of said crimping portions are selected to establish said first pressure threshold.

17. A display system, comprising:

a lamp assembly including an integral reflector and heat sink having crimping portions, a cathode assembly having an isolation ring coupled thereto, a spring washer located at least partially between said crimping portions and said isolation ring; and a generally ring shaped seal located between said integral reflector and heat sink and said isolation ring for providing a hermetic seal between said integral reflector and heat sink and said cathode assembly;

an illumination optics assembly optically coupled to said lamp assembly; and a spatial light modulator optically coupled to said illumination optics assembly;

a gas escape pathway configured to provide a controlled release of pressurized gas when an expansion force exerted on said cathode assembly is greater than a sealing force applied by said crimping portion and said spring washer.

18. The system of claim 17, and further comprising an image processing unit configured to control said spatial light modulator.

19. The system of claim 17, and further comprising display optics optically coupled to said spatial light modulator.

20. A method of sealing a lamp assembly, comprising:

coupling a ring seal to an integral reflector and heat sink, said integral reflector and heat sink having at least one crimping portion;

coupling a cathode assembly to said ring seal;

coupling a spring washer to said cathode assembly;

selectively crimping said crimping portions against said spring washer to apply a compressive force to said spring washer, said compressive force resulting in a sealing force between said ring seal and said cathode assembly below a first pressure threshold and providing a gas escape pathway above said first pressure threshold; and controlling the release of pressurized gas through said gas escape pathway when an expansion force exerted on said cathode assembly is greater than said sealing force.

21. The method of claim 20, and further comprising establishing a degree of crimping of said crimping portions to establish said first pressure threshold.

22. The method of claim 20, and further comprising establishing dimensions of said crimping portions to establish said first pressure threshold.

23. A lamp assembly, comprising:

light generating means for producing concentrated light in the presence of pressurized gas;

a window;

sealing means coupled to said window for sealing said pressurized gas within said lamp assembly reflector means for reflecting said concentrated light to a desired location, said reflector including retaining means for retaining said sealing means and said window in contact therewith while providing a gas escape pathway for said pressurized gas when said pressurized gas exceeds a first pressure threshold;

wherein said gas escape pathway is configured to provide a controlled release of said pressurized gas when an expansion force created by said pressurized gas is greater than a sealing force applied by said sealing means.

24. The assembly of claim 23, wherein said retaining means may be controlled to establish said first pressure threshold.

25. The lamp assembly of claim 4, wherein said gas escape pathway is a gap created between said isolation ring and said compressible seal member.

* * * * *

UNITED STATES PATENT AND TRADEMARK OFFICE

CERTIFICATE OF CORRECTION

PATENT NO. : 7,423,366 B2
APPLICATION NO. : 11/093667
DATED : September 9, 2008
INVENTOR(S) : John M. Koegler et al.

It is certified that error appears in the above-identified patent and that said Letters Patent is hereby corrected as shown below:

On the title page, after "(76) Inventors:" delete "John M. Koelger" and insert therefor --John M. Koegler--

In Column 6, Line 29, after "gas" delete "is"

Signed and Sealed this

Tenth Day of November, 2009

David J. Kappos

David J. Kappos
*Director of the United States Patent and Trademark Office*